US012736281B2

(12) United States Patent
Warta

(10) Patent No.: US 12,736,281 B2
(45) Date of Patent: Sep. 15, 2026

(54) METHOD FOR GENERATING REFRIGERATION FOR A CARBON MONOXIDE COLD BOX

(71) Applicant: Andrew M. Warta, Wheatfield, NY (US)

(72) Inventor: Andrew M. Warta, Wheatfield, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 460 days.

(21) Appl. No.: 16/707,190

(22) Filed: Dec. 9, 2019

(65) Prior Publication Data

US 2021/0172678 A1 Jun. 10, 2021

(51) Int. Cl.
*F25J 3/02* (2006.01)
*F25J 1/02* (2006.01)

(52) U.S. Cl.
CPC ..... *F25J 3/0261* (2013.01); *F25J 1/0258* (2013.01); *F25J 3/0223* (2013.01); *F25J 1/0271* (2013.01); *F25J 2205/04* (2013.01); *F25J 2210/18* (2013.01); *F25J 2240/00* (2013.01); *F25J 2270/02* (2013.01); *F25J 2270/904* (2013.01)

(58) Field of Classification Search
CPC ..... F25J 3/0261; F25J 1/0258; F25J 3/0223; F25J 1/0271; F25J 2205/04; F25J 2210/18; F25J 2240/00; F25J 2270/02; F25J 2270/904; F25J 3/0233; F25J 2200/40; F25J 2200/70; F25J 2205/40; F25J 2205/64; F25J 2210/04; F25J 2210/42; F25J 2245/02; F25J 2270/04; F25J 2270/24; F25J 2280/02; F25J 2280/20; F25J 3/0252; F25J 3/0271; F25J 3/223; F25J 3/0625; F25J 3/0665; F25J 3/0675; C01B 2203/046; C01B 3/506
See application file for complete search history.

(56) References Cited

U.S. PATENT DOCUMENTS 3,808,826 A * 5/1974 Harper ..... F25J 1/0258 62/612
4,217,759 A 8/1980 Shenoy
4,566,886 A * 1/1986 Fabian ..... F25J 3/0223 62/619
4,738,699 A * 4/1988 Apffel ..... F25J 3/0209 62/623
5,133,793 A 7/1992 Billy
5,609,040 A 3/1997 Billy et al.
5,832,747 A * 11/1998 Bassett ..... F25J 3/0261 62/931
6,098,424 A 8/2000 Gallarda et al.
(Continued)

FOREIGN PATENT DOCUMENTS

CN 111886465 A * 11/2020 ..... F25J 3/0223
EP 4210638 A1 3/1993
(Continued)

*Primary Examiner* — Jenna M Maroney
(74) *Attorney, Agent, or Firm* — Iurie A. Schwartz

(57) ABSTRACT

The present invention is directed to a method of separating carbon monoxide from syngas mixtures by cryogenic means where a partial condensation cycle is generally employed, and more specifically varying refrigeration generation based on income feed composition of the hydrocarbon feedstock being processed.

4 Claims, 1 Drawing Sheet

(56) References Cited

U.S. PATENT DOCUMENTS 6,266,976 B1 * 7/2001 Scharpf ..... F25J 3/0261 62/621
7,617,701 B2 * 11/2009 Billy ..... C10K 3/06 62/631
8,869,553 B2 * 10/2014 Court ..... G01M 17/0078 62/920
9,410,738 B2 8/2016 Briglia et al.
2007/0056319 A1 * 3/2007 Billy ..... F25J 3/0271 62/620
2009/0025422 A1 * 1/2009 Sicinski ..... F25J 1/0022 62/611
2009/0293539 A1 12/2009 Briglia et al.
2010/0122552 A1 * 5/2010 Schwartz ..... C01B 3/38 62/617
2011/0056239 A1 3/2011 Court et al.
2012/0060554 A1 * 3/2012 Schmidt ..... C10L 3/105 62/620
2012/0279254 A1 * 11/2012 Darde ..... F25J 3/0261 62/617
2012/0297821 A1 * 11/2012 Baxter ..... F25J 3/067 62/617
2015/0114035 A1 4/2015 Briglia et al.
2018/0058757 A1 * 3/2018 Shah ..... F25J 3/02
2021/0055048 A1 * 2/2021 Hernandez ..... F25J 3/0233
2021/0071947 A1 * 3/2021 Schwartz ..... F25J 3/0261

FOREIGN PATENT DOCUMENTS

JP S64-49881 2/1989
JP 03-267680 11/1991
JP 07-55331 3/1995
WO WO-2010015764 A2 * 2/2010 ..... C01B 3/382
WO 2018/039313 3/2018
WO WO-2021046321 A1 * 3/2021 ..... C01B 3/24

* cited by examiner

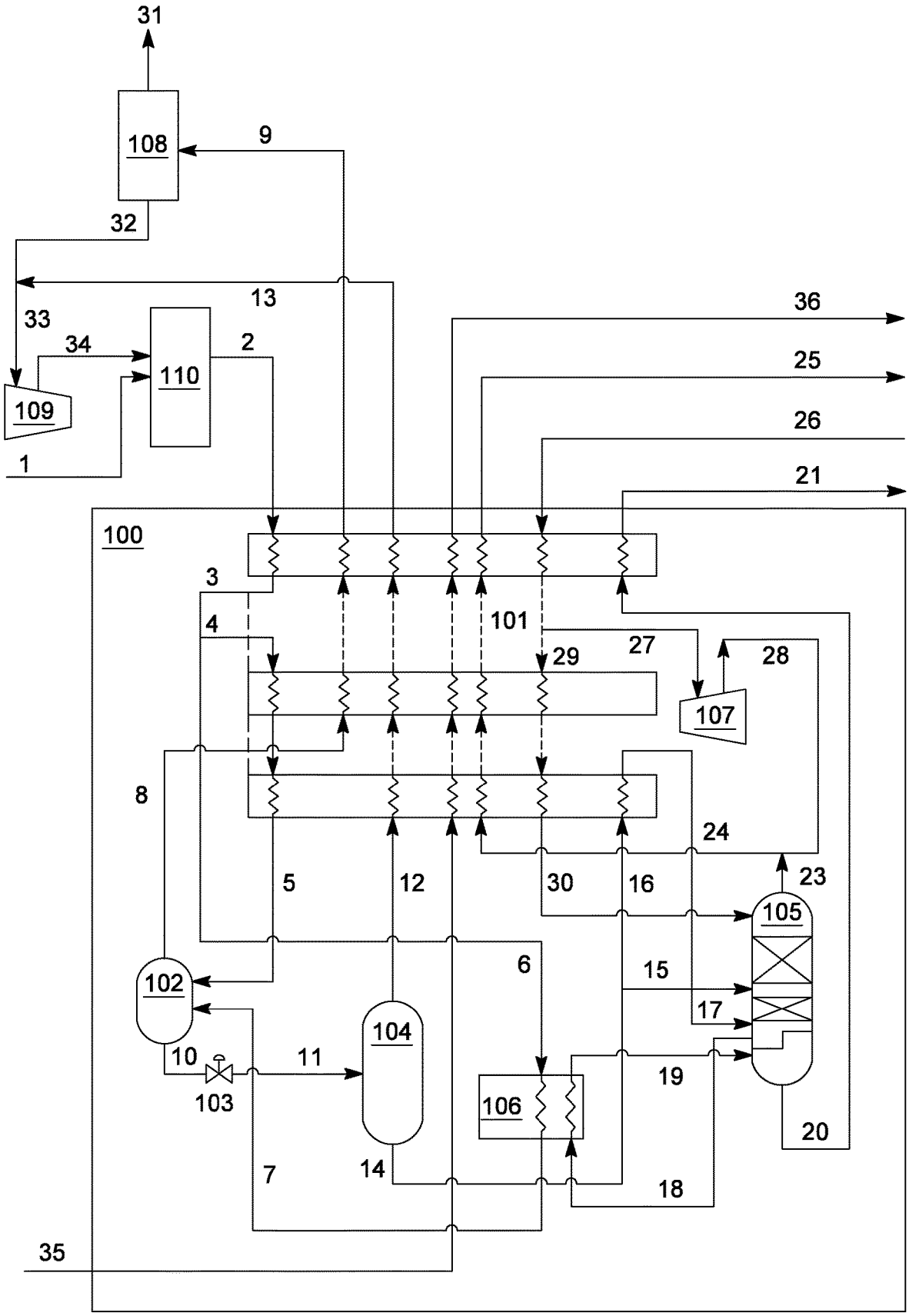
31
108
9
32
13
33
34
110
2
109
1
36
25
26
21
100
3
4
101
29
27
28
107
8
24
5
12
30
16
23
105
6
15
102
17
104
10
11
19
103
106
20
7
14
18
35

METHOD FOR GENERATING REFRIGERATION FOR A CARBON MONOXIDE COLD BOX

BACKGROUND OF THE INVENTION

Field of the Invention

The present invention relates to a method of separating carbon monoxide from a synthesis gas containing hydrogen, carbon monoxide, methane, water, and carbon dioxide. More specifically, the invention is directed to a method for improving the range of a cryogenic carbon monoxide purification process by varying refrigeration generation based on income feed composition of the hydrocarbon feedstock being processed.

Description of Related Art

Hydrocarbons such as natural gas, naphtha, or liquefied petroleum gas (LPG) can be catalytically converted with steam in a reformer to obtain a synthesis gas (i.e., a mixture of hydrogen ($H_2$), carbon monoxide (CO), methane ($CH_4$), water ($H_2O$), and carbon dioxide ($CO_2$) commonly referred to as "syngas"). The reformer process including reformation in a partial oxidation reformer, autothermal reformer, or a steam methane reformer is well known, and it is typically utilized to obtain syngas which is ultimately utilized in the production of hydrogen or chemicals such as methanol and ammonia. Conventional techniques for the separation of CO from the rest of the syngas constituents have been known. For instance, cryogenic purification methods, such as partial condensation or scrubbing with liquid methane are well known techniques. Other processes employed for the purification are adsorption processes such as pressure swing adsorption ones.

Production of the CO product typically requires multiple separation and distillation steps within an insulated cold box. Refrigeration much be generated or provided to the process to make up for unrecovered refrigeration from streams exiting heat exchangers (warm end delta T—WEDT) and any heat leak into the system. This refrigeration is often generated in one of two ways, by addition of cryogenic liquid such as liquid nitrogen ($LN_2$), or expansion of a process stream in an expansion turbine.

When utilizing an expansion turbine, it is typically sized to yield a high efficiency at a given turbine flowrate. This flowrate will typically be one optimization variable for the overall process. For processes where incoming feed composition is expected to vary, there is often a tradeoff between maximizing turbine efficiency and designing for a larger turbine flowrate range. In some instances, the incoming feedstock composition range ("feedstock" and "feed" are referred to interchangeably herein) may be so large that designing the expansion turbine to operate over the entire range would require a significant efficiency penalty to all operating points. Alternatively, there may be incoming feedstock compositions that are expected to occur for a small percentage of the overall operational life of the process. In these cases, it is undesirable to select a turbine efficiency and flow range to handle these incoming feedstock compositions as they would have a negative impact on turbine (and in turn, the overall plant) efficiency during much of the operational time.

In the related art for CO production, the typical design of a cryogenic CO purification facility will generate refrigeration for the process through either expansion of a process stream in a turbine, or the addition of a cryogenic liquid (e.g. liquid nitrogen). For example, U.S. Patent Application Publication No. 2011/0056239 A1 to Court et al. discloses the generation of refrigeration for a CO cold box from two sources. Namely, the reduction in pressure of the main syngas feed, and addition of liquid nitrogen. Particularly the introduction of liquid nitrogen into an upper portion of the stripping ("flash") column. However, Court et al does not mention varying the amount of liquid nitrogen (or to the other sources) based on the changes to the feed composition.

U.S. Pat. No. 6,266,976 to Scharp teaches the production of refrigeration in the production of CO with an impure expander. While there is a recognition of the fact that refrigeration may depend on the size of the plant, it does not address the change in process flows as dictated by a given feedstock composition.

Thus, is desirable to expand the range of incoming feedstock compositions to be processed by a cryogenic CO purification process without negative impact to the overall process efficiency that comes from designing expansion turbines for a large operational range.

The present invention overcomes the deficiency in the related art by utilizing both sources of refrigeration for a given facility, and varying the flow of cryogenic liquid based on the incoming feed composition. More specifically, the invention increases the range of incoming feedstock compositions that may be processed by a given cryogenic CO purification facility by varying a make-up flow of cryogenic liquid to satisfy changes in refrigeration requirements due to variations in incoming feedstock composition without requiring large changes in turbine flowrate.

Other objects and aspects of the present invention will become apparent to one of ordinary skill in the art upon review of the specification, drawings and claims appended hereto.

SUMMARY OF THE INVENTION

According to an aspect of the invention, a method for the separation of carbon monoxide from a syngas feedstock in a carbon monoxide cold box where the cold box refrigeration is varied based on the composition of the incoming feedstock is provided. The method includes:

- cooling and partially condensing the syngas cold box feed stream containing carbon monoxide and hydrogen in a primary heat exchanger to produce a cooled and partially condensed syngas feed stream;
- separating the cooled and partially condensed syngas feed stream into a first hydrogen rich vapor stream and a first carbon monoxide rich liquid stream in a first separator;
- feeding the first carbon monoxide rich liquid stream to a second hydrogen removal separator operating at a pressure lower than the first separator, wherein a second hydrogen rich vapor stream is separated from a second crude carbon monoxide rich liquid stream;
- splitting said second crude carbon monoxide rich liquid stream into two portions wherein a first portion of the second crude carbon monoxide liquid rich stream is at least partially vaporized in the primary heat exchanger and providing a second portion of the second crude carbon monoxide rich liquid stream wherein both portions are introduced into a distillation column for separating purified carbon monoxide product stream from a methane rich liquid byproduct stream;
- providing a turbine feed stream to a turbine disposed within said cold box; and providing a cryogenic fluid feed to said cold box and varying the flow rate based on the composition of the incoming feedstock.

BRIEF DESCRIPTION OF THE FIGURE

The objects and advantages of the invention will be better understood from the following detailed description of the preferred embodiments thereof in connection with the accompanying figure wherein like numbers denote same features throughout and wherein:

FIG. 1 illustrates a process flow diagram of a partial condensation cold box cycle in accordance with the invention where the refrigeration is provided from a make-up flow of cryogenic liquid and a turbine in response to feedstock composition.

DETAILED DESCRIPTION OF THE INVENTION

The present invention provides for the cryogenic separation of carbon monoxide from mixtures containing at least hydrogen, carbon monoxide, and methane, particularly in cases where the feedstock composition (e.g., methane) varies thereby necessitating changes in the required refrigeration. More specifically, the technical advantage is derived from increasing the range of operability for a CO cold box process by altering the refrigeration balance of the plant in response to changes in composition of the incoming feed. Typically, the expansion turbine is designed to operate over a range of flowrates. As this range increases, the efficiency for the turbine will typically decrease. In general, the peak turbine efficiency is desired for the flowrate the process will operate at most often, or when flowrates are expected to change often, the overall efficiency for an expected timeframe is maximized, considering the varying flowrates during that timeframe.

An important aspect of the invention is allowing for a larger range of incoming feed compositions to be processed without requiring the turbine design to account for incoming feed compositions which would unduly increase the required turbine flowrate range. For a typical process, as the methane component in the feedstock increase, the flowrate required through the turbine may increase. When these high methane composition feeds are not expected to occur often, this increased turbine flowrate range would result in decreased overall efficiency, and likely the need for a larger turbine. By supplementing refrigeration through the addition of a cryogenic liquid (e.g. liquid nitrogen), the turbine flowrate range is reduced, leading to better overall efficiency. As a result, the present invention allows the turbine to operate at a more efficient flowrate while still allowing for variations in incoming feed composition. Varying the flowrate of additional cryogenic liquid (e.g., liquid nitrogen) based on incoming feed compositional changes while continuing to operate the turbine allows for increased plant operability and better overall plant efficiency with a potential reduction of about 5 to 20% in the maximum turbine design flow.

With reference to FIG. 1, a syngas feed stream (1) generated at near ambient temperature and elevated pressure, typically ranging from about 250 and 500 psig by an autothermal reformer, partial oxidation reactor, or other syngas generator (not shown) is treated to remove most of the carbon dioxide (not shown). The syngas feed stream (1) is routed to a dryer device (110) to remove the contained water to produce a cold box feed stream (2). Water ($H_2O$) and carbon dioxide ($CO_2$) are removed from the syngas stream to levels below the detection limit of most conventional analyzers; $H_2O$ is typically removed to below 10 ppb, preferably less than 1 ppb, and $CO_2$ is typically removed to below 100 ppb, preferably less than 25 ppb. A high pressure recycle stream of flash gas (13) and tail gas (32), both of which are discussed in detail below, are mixed to form low pressure recycle mixture stream (33) which is compressed and routed to dryer (110) in the process of removing the residual water and carbon dioxide from syngas feed stream (1). The dryer (110) is typically regenerated using a portion of the cold box feed or nitrogen (not shown).

Cold box feed stream (2) has its composition measured, particularly for methane which is generally less than 4 volume percent for a process feedstock generated by an autothermal reactor, and is routed to a process heat exchanger (101) disposed within cold box (100). Depending on the content of methane in this cold box feed stream (2), the dew point temperature for this stream can range from about 103.5 K to about 112.3 K. This feed stream (2) exits the process heat exchange (101) as a cooled cold box feed stream (3), typically at a temperature ranging from 130 to 140 K. The cooled cold box feed stream (3) is split into a partial condensation feed stream (4) and hot reboiler stream (6). The partial condensation feed stream (4) is cooled further in the process heat exchanger (101) to a temperature typically ranging from about 85 and 95 K, so that part of the stream is partially condensed and exits the heat exchanger as a partially condensed feed stream (5), which is routed to a high-pressure separator (102).

The hot reboiler feed stream (6) provides heat to a reboiler (106) and exits the reboiler as a cooled reboiler feed stream (7) (typically operating at temperatures ranging from about 85-100 K), which is also fed to the high-pressure separator (102) typically operating at pressures ranging from about 250 to 500-psig to produces a high-pressure carbon monoxide rich liquid stream (10) and a crude hydrogen vapor stream (8), which is warmed in the process heat exchanger (101) to produce a warmed crude hydrogen stream (9) that is subsequently fed to a pressure swing adsorption system (108) to separate hydrogen product (31) and tail gas (32).

The high-pressure carbon monoxide rich liquid stream (10) is expanded across a valve (103) to produce a low-pressure separator feed (11) that is fed to a low-pressure separator (104), typically operating between 20 and 50 psig. The low-pressure separator (104) can be a single-stage separator vessel as shown in FIG. 1 or a dual-stage separator, a multi-stage distillation or stripping column, or other means to remove most of the hydrogen contained in the low-pressure separator feed stream (11). Other streams not relevant to the invention, not shown, would be required for a dual-stage separator or multi-stage column. Selection of the device employed for the low-pressure separator (104) depends on the hydrogen purity requirement of the carbon monoxide product. The low-pressure separator (104) produces a second hydrogen rich vapor stream (12) consisting primarily of hydrogen (in a range from about 40-60%) and carbon monoxide (in a range from about 40-60%) with small amounts of methane, nitrogen, and argon. This second hydrogen rich vapor stream (12) is removed from an upper portion of the low-pressure separator (104) and a second crude carbon monoxide rich liquid stream (14) removed from a lower section of the low-pressure separator (104). The second hydrogen rich vapor stream (12) is directed into the process heat exchanger (101) where it is warmed to produce a flash gas stream (13). The second crude carbon monoxide rich liquid stream (14) is divided into a direct column feed stream (15) and a liquid split feed (16). The direct column feed (15) is fed directly to a distillation column (105) while the liquid split feed (16) is at least partially vaporized in the process heat exchanger (101) to form a vaporized column feed stream (17), which is fed to the distillation column (105) at a location below the direct column feed (15) location.

Distillation column (105) typically operates at pressures ranging from about 5 to 25 psig and separates the streams fed into it to produce a cold purified carbon monoxide product stream (23) at the upper portion of column (105) and a methane rich liquid byproduct stream (20) which is removed from lower portion of said column (105). The concentration of methane in the methane rich liquid byproduct stream (20) which could range anywhere from 70 to 98% (by volume), preferably 85 to 95% (by volume) is routed to the process heat exchanger (101) where it is vaporized and heated to produce a fuel gas stream (21). Concurrently, a reboiler liquid stream (18) is removed from a lower portion of the distillation column (105) and routed to reboiler (106) where it is heated to produce a partially boiled bottoms stream (19) that is returned to the sump of the distillation column (105).

The cold purified carbon monoxide product stream (23) is mixed with a turbine exhaust stream (28) to form a combined cold purified carbon monoxide product (24), which is heated in the process heat exchanger (101) to produce a warm purified carbon monoxide product stream (25), which is typically compressed (not shown) and a portion removed at higher pressure as a recovered product. A different portion of the compressed warm purified carbon monoxide product is recycled to the cold box as a carbon monoxide recycle stream (26), typically ranging from about 100 to 200 psig which can be at the same pressure as the recovered product or at a different pressure if it is compressed in a different number of stages in the carbon monoxide compressor.

The carbon monoxide recycle stream (26) is cooled in the process heat exchanger (101) and split into a turbine feed stream (27) and a warm carbon monoxide reflux stream (29). The turbine feed (27), which is typically at a similar temperature to the cooled cold box feed (3) of about 130 to 140 K, is expanded in a turbine (107) to produce the turbine exhaust stream (28), which is at lower pressure, typically at or slightly above the distillation column (105) pressure of 5 to 25 psig, and lower temperature than the turbine feed (27), typically close to its dew point or possibly containing a small amount of liquid. The warm carbon monoxide reflux stream (29) is cooled further in the process heat exchanger (101) to produce a cold carbon monoxide reflux liquid stream (30), which is fed to the distillation column (105) as a reflux stream to improve cold purified carbon monoxide product stream's (23) purity.

As referenced above, the pressure swing adsorption system (108) produces a high-purity hydrogen product stream (31) and a low-pressure tail gas stream (32) that contains in a range of about 40 to 60% hydrogen and in a range of about 40 to 60% carbon monoxide and a few percentages of methane, nitrogen and argon. The tail gas stream (32), the flash gas stream (13) are combined to produce a low-pressure recycle mixture stream (33). The low-pressure recycle mixture stream (33) is compressed in a recycle gas compressor (109) to produce the high-pressure recycle stream (34) that is fed to the dryer (110).

When additional refrigeration beyond that produced by the process in the system above is desired, a cryogenic liquid feed stream (35) can be added to the process heat exchanger (101). This stream is removed as a warmed refrigeration vapor stream (36) upon transferring refrigeration to the process. The cryogenic liquid feed stream (35) is generally liquid nitrogen with a typical pressure ranging from about 5 to 50 psig corresponding to an inlet temperature ranging from about 80 and 93 K. The cryogenic liquid feed (35) may also be used during operation when the turbine (107) is not operating to sustain the refrigeration balance of the process.

In an exemplary embodiment of the present invention, the flow rate of the cryogenic liquid feed (35) is varied based on the methane composition of cold box feed (2), while continuing the operation of turbine (107). In a preferred embodiment, when the methane content of the cold box feed (2) is less than or equal to about 3.6 percent by volume methane, the flow rate of the turbine feed (27) is equal to or less than the maximum turbine flow rate of about 655 lbmole/hr. In this instance, the flowrate of cryogenic liquid feed (35) is zero lbmole/hr of liquid nitrogen. On the other hand, in an embodiment where the methane content of the cold box feed (2) is greater than 3.6 percent by volume methane, the flow rate of cryogenic liquid feed (35) is greater than zero lbmore/hr of liquid nitrogen. In a specific embodiment, where the methane content in the cold box feed (2) is about 4.0 percent, the flow rate of the cryogenic liquid feed is 16 lbmole/hr of liquid nitrogen. It is further envisioned that the cold box (100) may be operated where the turbine is disabled or simply without a turbine (107). In this scenario, the cryogenic liquid feed (35) would be varied based on the methane composition of the cold box feed (2).

While the invention has been described in detail with reference to specific embodiments thereof, it will become apparent to one skilled in the art that various changes and modifications can be made, and equivalents employed, without departing from the scope of the appended claims.

What is claimed is:

1. A method for the separation of carbon monoxide from a syngas feedstock in a carbon monoxide cold box where the cold box is provided refrigeration based on the composition of the incoming syngas feedstock, comprising:

cooling and partially condensing a cold box syngas feed stream containing carbon monoxide and hydrogen in a primary heat exchanger to produce a cooled and partially condensed syngas feed stream;

separating the cooled and partially condensed syngas feed stream into a first hydrogen rich vapor stream and a first carbon monoxide rich liquid stream in a first separator;

feeding the first carbon monoxide rich liquid stream to a second hydrogen removal separator operating at a pressure lower than the first separator, wherein a second hydrogen rich vapor stream is separated from a second crude carbon monoxide rich liquid stream;

splitting said second crude carbon monoxide rich liquid stream into two portions wherein a first portion of the second crude carbon monoxide rich liquid stream is at least partially vaporized in the primary heat exchanger and providing a second portion of the second crude carbon monoxide rich liquid stream wherein both portions are introduced into a distillation column for separating purified carbon monoxide product stream from a liquid byproduct stream;

providing a turbine feed stream to a turbine disposed within said cold box; and providing a cryogenic fluid feed to said cold box from a source external to the carbon monoxide cold box only when the methane content in the incoming cold box syngas feed stream is greater than 3.6 percent.

2. The method of claim 1, further comprising: operating the cold box in a mode when the methane content in the cold box syngas feed stream is less than or equal to 3.6 percent methane, and the flow rate of the cryogenic fluid feed to the cold box is zero lbmole/hr.

3. The method of claim 2, wherein the flow rate of the turbine feed stream to the turbine is equal to or less than 655 lbmole/hr.

4. The method of claim 1, wherein the liquid byproduct stream contains at least 50% methane.

* * * * *